US008070257B2

(12) United States Patent
Kayahara

(10) Patent No.: US 8,070,257 B2
(45) Date of Patent: Dec. 6, 2011

(54) LIQUID EJECTING APPARATUS

(75) Inventor: Naoki Kayahara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 178 days.

(21) Appl. No.: 12/387,599

(22) Filed: May 4, 2009

(65) Prior Publication Data

US 2009/0273631 A1 Nov. 5, 2009

(30) Foreign Application Priority Data

May 2, 2008 (JP) ..... 2008-120625

(51) Int. Cl.
*B41J 2/15* (2006.01)

(52) U.S. Cl. ..... 347/43

(58) Field of Classification Search ..... 347/40, 347/42, 43

See application file for complete search history.

(56) References Cited

U.S. PATENT DOCUMENTS

| | | | | |
|---|---|---|---|---|
| 6,648,446 | B1 * | 11/2003 | Rutland et al. | 347/21 |
| 6,942,308 | B2 * | 9/2005 | Molinet et al. | 347/4 |
| 2007/0120904 | A1 * | 5/2007 | Sekiguchi | 347/85 |
| 2008/0018703 | A1 * | 1/2008 | Nakano et al. | 347/43 |

FOREIGN PATENT DOCUMENTS

| | | |
|---|---|---|
| JP | 02-078558 | 3/1990 |
| JP | 08-039798 | 2/1996 |
| JP | 2002-067317 | 3/2002 |
| JP | 2002-120386 | 4/2002 |
| JP | 2002-137388 | 5/2002 |
| JP | 2002-192719 | 7/2002 |
| JP | 2003-127352 | 5/2003 |

* cited by examiner

*Primary Examiner* — Lamson Nguyen
(74) *Attorney, Agent, or Firm* — Nutter McClennen & Fish LLP; John J. Penny, V.

(57) ABSTRACT

A liquid ejecting apparatus includes a first head having a first nozzle group in which nozzles from which a first liquid is ejected are aligned in a nozzle-row direction at a predetermined pitch and a second nozzle group in which nozzles from which a second liquid is ejected are aligned in the nozzle-row direction at the predetermined pitch, the nozzles in the first nozzle group being positioned between the nozzles in the second nozzle group in the nozzle-row direction; a second head having a third nozzle group in which nozzles from which the first liquid is ejected are aligned in the nozzle-row direction at the predetermined pitch and a fourth nozzle group in which nozzles from which the second liquid is ejected are aligned in the nozzle-row direction at the predetermined pitch, the nozzles in the third nozzle group being positioned between the nozzles in the fourth nozzle group in the nozzle-row direction; and a moving mechanism that moves the first head and the second head relative to a medium in a direction intersecting the nozzle-row direction. In the nozzle-row direction, the nozzles in the third nozzle group are positioned between the nozzles in the first nozzle group, and the nozzles in the fourth nozzle group are positioned between the nozzles in the second nozzle group.

9 Claims, 11 Drawing Sheets

LIQUID EJECTING APPARATUS

BACKGROUND

1. Technical Field

The present invention relates to liquid ejecting apparatuses.

2. Related Art

Liquid ejecting printers that form images by ejecting ink droplets onto sheets are widely used. The head of such a printer includes a plurality of nozzle rows in which nozzles are aligned in a nozzle-row direction and from which ink droplets of respective colors are ejected. In a particular head, the nozzles in different nozzle rows are arranged at the same positions as each other in the nozzle-row direction. The printer includes a plurality of such heads, and performs printing by moving the heads or a sheet in a direction intersecting the nozzle-row direction. Exemplary printers are disclosed in JP-A-2003-127352 and JP-A-2002-192719.

If ink droplets are continuously ejected from all the nozzles, ink droplets are ejected from positions that are the same as each other in the nozzle-row direction in a single head. In such a case, ink droplets of respective colors land on common raster lines before preceding ink droplets have dried. This may cause ink droplets of a certain color to land on wet ink of another color. As a result, inks often become mixed with each other after landing, causing blurring of the inks.

Mixing between inks after landing may occur when the duty of liquid ejection is high, even if ink droplets are not continuously ejected from all the nozzles.

SUMMARY

An advantage of some aspects of the invention is that, in a case where a plurality of liquids are ejected in a form of droplets, mixing between the liquid droplets on a medium is suppressed.

At least the following features and advantages will become apparent from this specification and the accompanying drawings.

According to an aspect of the invention, a liquid ejecting apparatus includes a first head having a first nozzle group in which nozzles from which a first liquid is ejected are aligned in a nozzle-row direction at a predetermined pitch and a second nozzle group in which nozzles from which a second liquid is ejected are aligned in the nozzle-row direction at the predetermined pitch, the nozzles in the first nozzle group being positioned between the nozzles in the second nozzle group in the nozzle-row direction; a second head having a third nozzle group in which nozzles from which the first liquid is ejected are aligned in the nozzle-row direction at the predetermined pitch and a fourth nozzle group in which nozzles from which the second liquid is ejected are aligned in the nozzle-row direction at the predetermined pitch, the nozzles in the third nozzle group being positioned between the nozzles in the fourth nozzle group in the nozzle-row direction; and a moving mechanism that moves the first head and the second head relative to a medium in a direction intersecting the nozzle-row direction. In the nozzle-row direction, the nozzles in the third nozzle group are positioned between the nozzles in the first nozzle group, and the nozzles in the fourth nozzle group are positioned between the nozzles in the second nozzle group.

With such a configuration, in the case where a plurality of liquids are ejected in a form of droplets, mixing between the liquid droplets on a medium can be suppressed.

In the liquid ejecting apparatus according to the above aspect, it is preferable that an interval between the second nozzle group and the third nozzle group be larger than an interval between the first nozzle group and the second nozzle group. It is also preferable that the first nozzle group, the second nozzle group, the third nozzle group, and the fourth nozzle group each include a plurality of nozzle rows in which the nozzles are aligned in the nozzle-row direction. Alternatively, the first nozzle group, the second nozzle group, the third nozzle group, and the fourth nozzle group may each include a single nozzle row in which the nozzles are aligned in the nozzle-row direction. It is also preferable that the first head and the second head be fixed to the liquid ejecting apparatus, whereas the medium be moved relative to the liquid ejecting apparatus.

The first head and the second head may be moved in a direction intersecting a direction in which the medium is moved. It is also preferable that ejection of liquid droplets from a nozzle at either end of each nozzle group in the first head and the second head be prevented. It is also preferable that the nozzles in the first nozzle group and the nozzles in the fourth nozzle group be arranged at the same positions as each other in the nozzle-row direction, and the nozzles in the second nozzle group and the nozzles in the third nozzle group be arranged at the same positions as each other in the nozzle-row direction. The liquid ejecting apparatus according to the above aspect may further include a third head having a fifth nozzle group in which nozzles from which the first liquid is ejected are aligned in the nozzle-row direction at the predetermined pitch and a sixth nozzle group in which nozzles from which the second liquid is ejected are aligned in the nozzle-row direction at the predetermined pitch, the nozzles in the fifth nozzle group being positioned between the nozzles in the sixth nozzle group in the nozzle-row direction. In this case, in the nozzle-row direction, the nozzles in the fifth nozzle group are positioned between the nozzles in the first nozzle group, and the nozzles in the sixth nozzle group are positioned between the nozzles in the second nozzle group. The liquid ejecting apparatus according to the above aspect may further include a dryer with which the liquids ejected onto the medium are dried between the first head and the second head.

With such a configuration, in the case where a plurality of liquids are ejected in a form of droplets, mixing between the liquid droplets on a medium can be suppressed.

Other features and advantages of the invention will become apparent from the following description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

General Embodiment

Overall Configuration of Printer 1

Figure 1A:
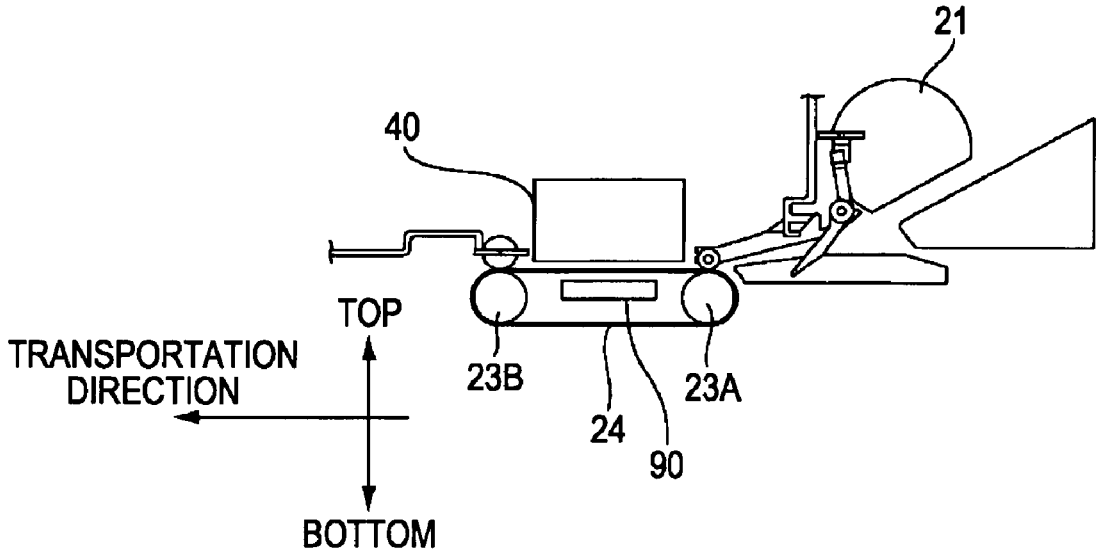
FIG. 1A is a cross-sectional view of a printer 1.
Figure 1B:
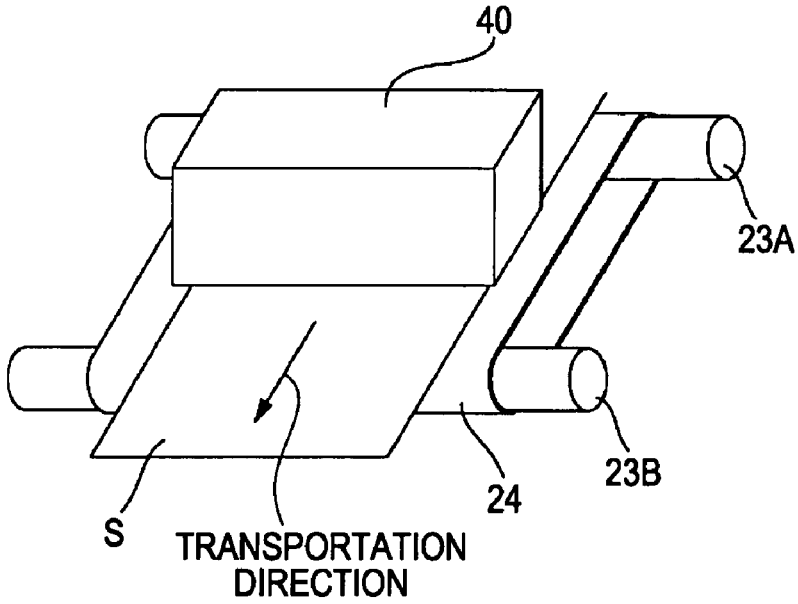
FIG. 1B is a perspective view for describing the transportation of a sheet S performed by the printer 1.
Figure 2:
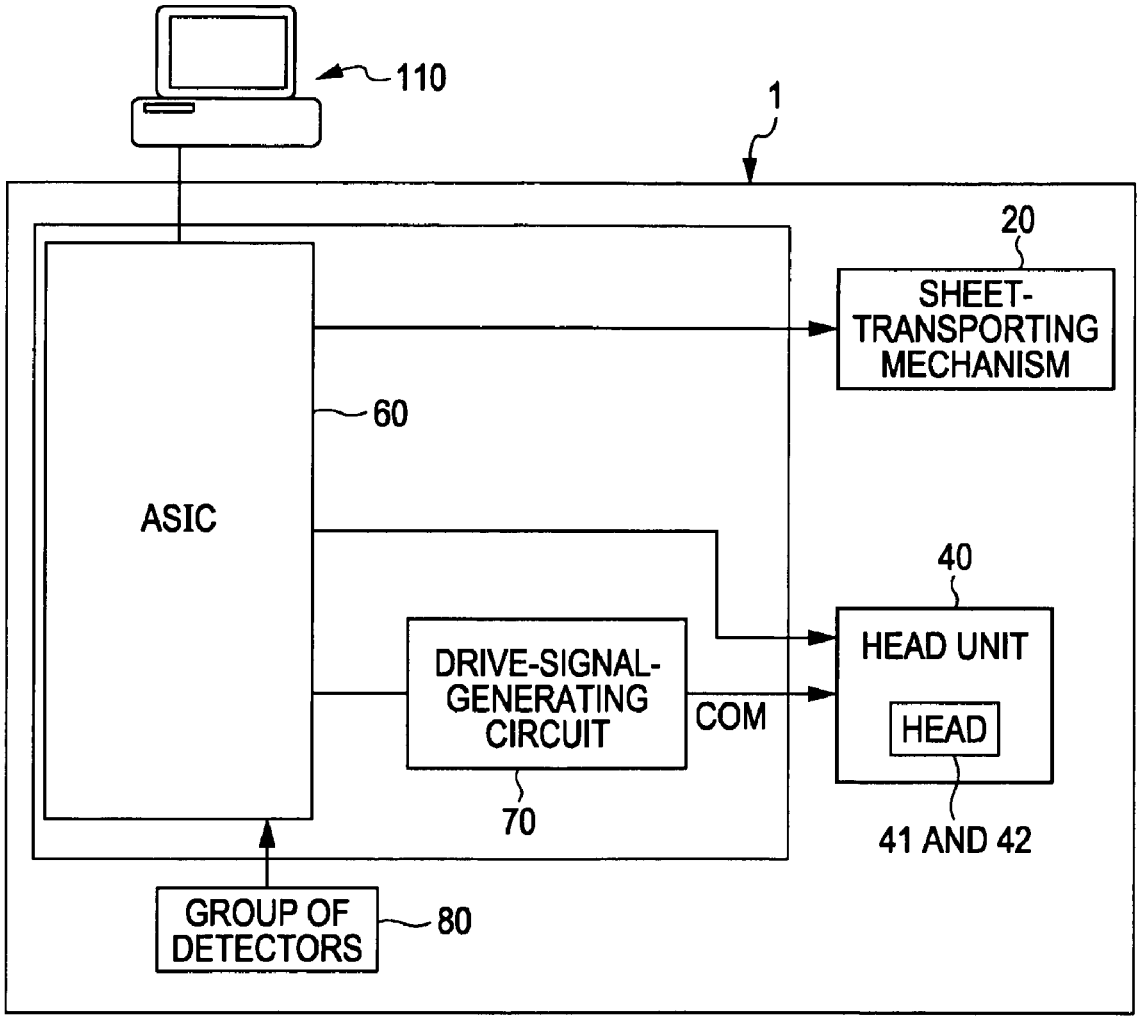
FIG. 2 is a block diagram of the printer 1.

FIG. 1A is a cross-sectional view of a printer 1 according to a general embodiment of the invention. FIG. 1B is a perspective view for describing the transportation of a sheet S performed by the printer 1. FIG. 2 is a block diagram of the printer 1. The basic configuration of the printer 1, which is a line printer, will now be described.

The printer 1 includes a sheet-transporting mechanism 20, a head unit 40, an application-specific integrated circuit (ASIC) 60, a drive-signal-generating circuit 70, and a group of detectors 80. The printer 1 receives print data from a computer 110. In accordance with the data that is received, the ASIC 60 of the printer 1 controls relevant elements (the sheet-transporting mechanism 20, the head unit 40, and the drive-signal-generating circuit 70) of the printer 1, whereby an image is printed on the sheet S.

The state of the printer 1 is monitored by the group of detectors 80. The group of detectors 80 output detection results to the ASIC 60. In accordance with the detection results, the ASIC 60 controls the aforementioned elements.

The sheet-transporting mechanism 20 transports a medium (the sheet S, for example) in a predetermined direction, which is a transportation direction. The sheet-transporting mechanism 20 includes a feeding roller 21, a transportation motor (not shown), an upstream transportation roller 23A, a downstream transportation roller 23B, and a belt 24. The feeding roller 21 feeds the sheet S that is inserted through a sheet insertion slot into the printer 1. When the transportation motor (not shown) rotates, the upstream transportation roller 23A and the downstream transportation roller 23B rotate, whereby the belt 24 rotates. The sheet S fed by the feeding roller 21 is transported by the belt 24 to a printable region (a region facing a head). With the transportation of the sheet S by the belt 24, the sheet S moves relative to the head unit 40 in the transportation direction. The sheet S that has passed the printable region is discharged by the belt 24 to the outside. During transportation, the sheet S is subjected to electrostatic attraction or vacuum suction on the belt 24.

The head unit 40 ejects ink droplets onto the sheet S. The head unit 40 forms dots on the sheet S by ejecting ink droplets onto the sheet S that is being transported, thereby printing an image on the sheet S. The printer 1 of the first embodiment is a line printer, and the head unit 40 thereof includes two heads: a first head 41 and a second head 42, which will be described below.

The ASIC 60 is a control unit that controls the printer 1. The ASIC 60 is connected to the computer 110 via an interface and can communicate with the computer 110. The ASIC 60 has an arithmetic function with which the entirety of the printer 1 is controlled. The ASIC 60 also includes a memory that stores programs and data. The ASIC 60 controls relevant mechanisms in accordance with such programs stored in the memory.

To cause ink droplets to be ejected from nozzles, the drive-signal-generating circuit 70 generates drive signals to be supplied to piezoelectric elements 521, described below, provided inside the heads. The drive-signal-generating circuit 70 outputs the drive signals to the head unit 40 in accordance with waveform data that is output from the ASIC 60.

Figure 3:
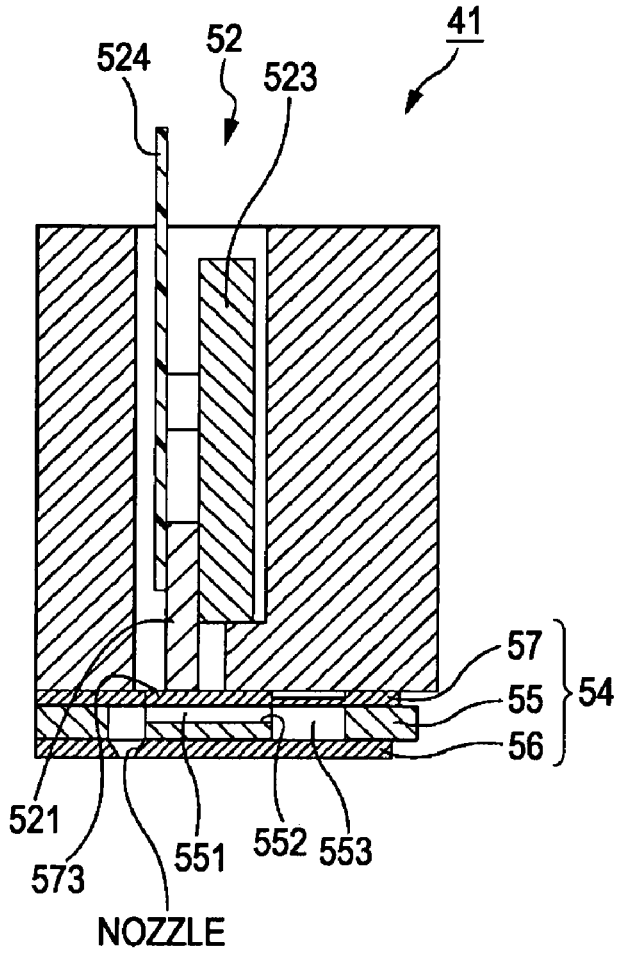
FIG. 3 is a cross-sectional view showing elements provided around a nozzle group.

FIG. 3 is a cross-sectional view showing elements provided around a nozzle group.

A drive unit 52 includes a plurality of piezoelectric elements 521, a securing plate 523 to which the piezoelectric elements 521 are secured, and a flexible cable 524 through which power is fed to the individual piezoelectric elements 521. The piezoelectric elements 521 are secured to the securing plate 523 in a so-called cantilever form. The securing plate 523 is a plate member having a rigidity sufficient for receiving reactive force from the piezoelectric elements 521. The flexible cable 524 is a sheet-type wiring board having flexibility, and is electrically connected to the ends of the respective piezoelectric elements 521 on the side opposite the side secured to the securing plate 523. The flexible cable 524 has on a surface thereof head control sections (not shown) serving as control integrated circuits that control, for example, driving of the piezoelectric elements 521. The head control sections are provided in correspondence with nozzle groups of each of the heads.

A channel unit 54 includes a channel plate 55, a nozzle plate 56, and an elastic plate 57, which are stacked to form an integral body such that the channel plate 55 is held between the nozzle plate 56 and the elastic plate 57. The nozzle plate 56 is a thin stainless-steel plate in which the nozzles are provided.

The channel plate 55 has a plurality of cuts serving as pressure chambers 551 and ink supply ports 552, which are provided in correspondence with the nozzles. A reservoir 553 is a liquid reservoir through which ink stored in an ink cartridge is supplied to the individual pressure chambers 551. The reservoir 553 communicates with ends of the respective pressure chambers 551 through the respective ink supply ports 552. Ink supplied from the ink cartridge and is introduced into the reservoir 553 through an ink supply tube (not shown). The elastic plate 57 has islands 573. The tips of the piezoelectric elements 521 at the free ends thereof are bonded to the respective islands 573.

When drive signals are supplied through the flexible cable 524 to the piezoelectric elements 521, each of the piezoelectric elements 521 expands or contracts, whereby the volume of the corresponding pressure chamber 551 increases or decreases. Such a change in the volume of the pressure chamber 551 causes a change in the ink pressure inside the pressure chamber 551. By utilizing the change in the ink pressure, an ink droplet can be ejected from the corresponding nozzle.

Figure 4:
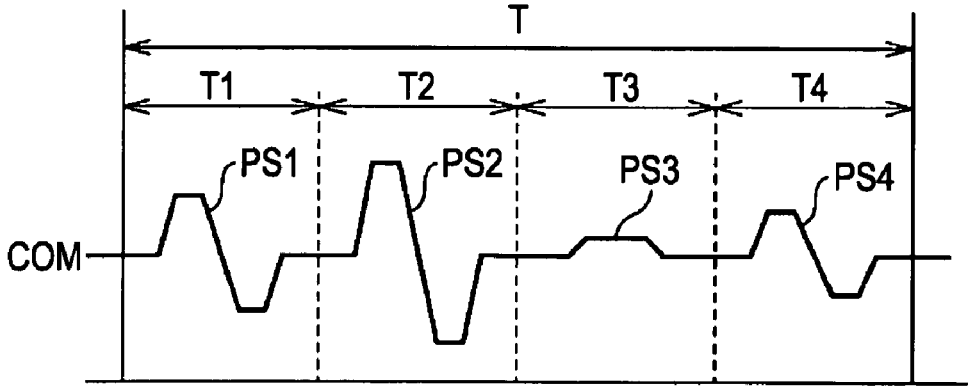
FIG. 4 shows a drive signal COM.

FIG. 4 shows a drive signal COM. The drive signal COM is generated repeatedly with a repetition period T. The drive signal COM has a first to fourth period T1 to T4 and includes a first drive pulse PS1 generated in the first period T1, a second drive pulse PS2 generated in the second period T2, a third drive pulse PS3 generated in the third period T3, and a fourth drive pulse PS4 generated in the fourth period T4.

When the first drive pulse PS1 is supplied to the piezoelectric element 521, an ink droplet corresponding to a medium dot is ejected onto the sheet S. When the second drive pulse PS2 is supplied to the piezoelectric element 521, an ink droplet corresponding to a large dot is ejected onto the sheet S. When the third drive pulse PS3 is supplied to the piezoelectric element 521, the piezoelectric element 521 is microvibrated, but ejection of an ink droplet is prevented. When the fourth drive pulse PS4 is supplied to the piezoelectric element 521, an ink droplet corresponding to a small dot is ejected onto the sheet S.

The first to fourth drive pulses PS1 to PS4 are supplied selectively to the piezoelectric elements 521, so that small dots, medium dots, and large dots are formed correspondingly on the sheet S. When the duty of ink ejection is low, small dots are ejected intermittently. As the duty of ejection becomes higher, larger dots are ejected continuously.

Figure 5:
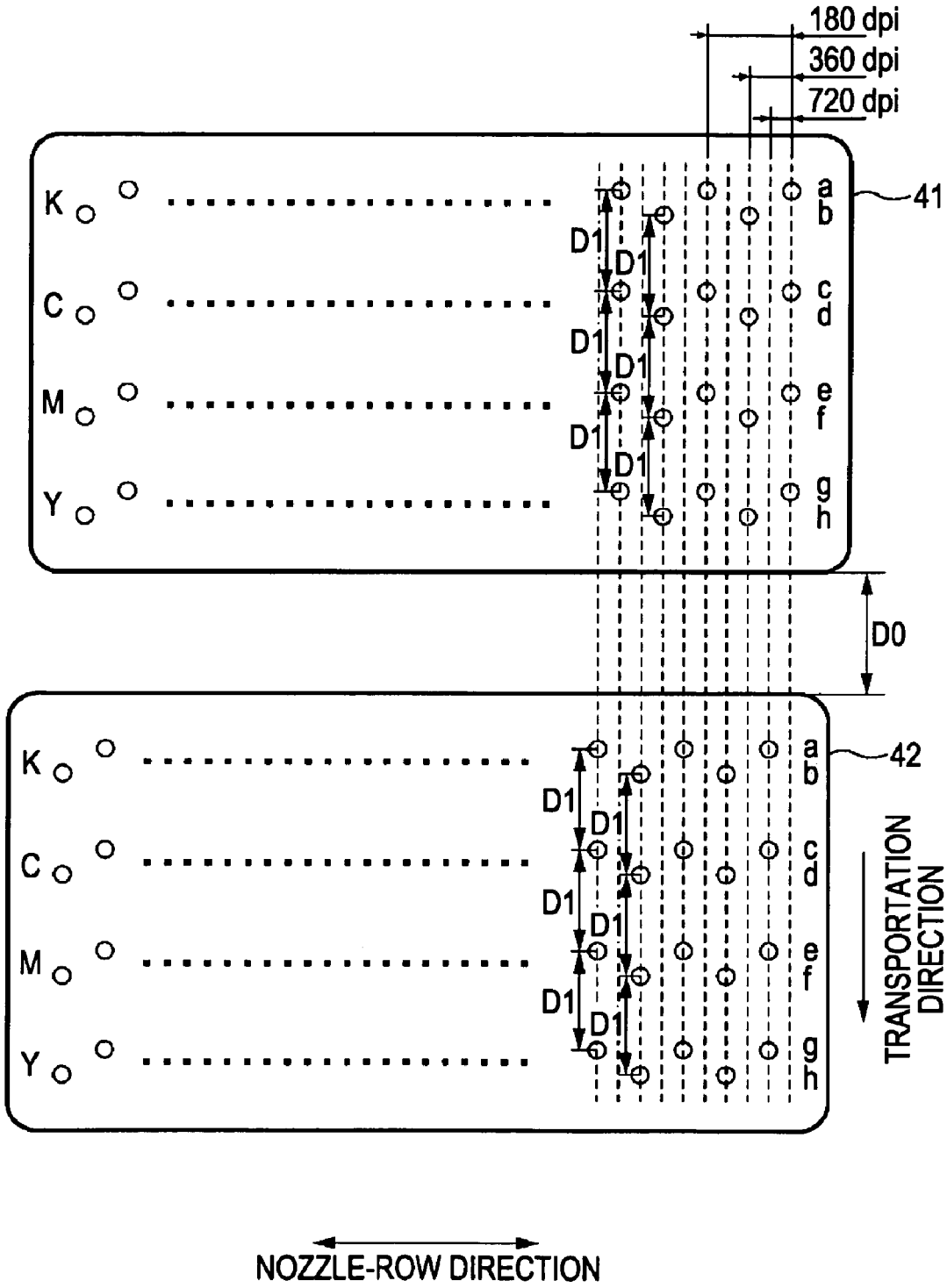
FIG. 5 shows nozzle arrangements of a first head 41 and a second head 42 according to a reference example.

FIG. 5 shows nozzle arrangements of a first head 41 and a second head 42 according to a reference example, seen from the top of the printer 1. Actually, nozzles provided at the bottom of the heads 41 and 42 cannot be seen, behind other elements, from the top of the printer 1. However, for convenience of description, the positions of the nozzles when seen from the top of the printer 1 are shown through the other elements.

In FIG. 5, because of space limitation, the lengths of the first head 41 and the second head 42 of the reference example in the nozzle-row direction are smaller than the actual lengths. The first head 41 and the second head 42 are each a full-line head in which nozzles are aligned in a sheet-width direction continuously from one end of each nozzle row to the other with a length larger than the sheet width. The first head 41 and the second head 42 can eject ink droplets in a range covering a full width of the sheet.

Referring to FIG. 5, the first head 41 resides on the upstream side and the second head 42 resides on the downstream side in the transportation direction. The nozzle arrangements of the first head 41 and the second head 42 of the reference example are the same.

The first head 41 has eight nozzle rows: nozzle rows a to h. The nozzle rows a and b constitute a black-ink nozzle group from which ink droplets of black K are ejected. The nozzle rows c and d constitute a cyan-ink nozzle group from which ink droplets of cyan C are ejected. The nozzle rows e and f constitute a magenta-ink nozzle group from which ink droplets of magenta M are ejected. The nozzle rows g and h constitute a yellow-ink nozzle group from which ink droplets of yellow Y are ejected. In short, the nozzle groups each include two nozzle rows.

The nozzles included in each of the nozzle rows a to h are arranged at a 180-dpi pitch. The two nozzle rows included in a single nozzle group are staggered with respect to each other in the nozzle-row direction by a distance of 360 dpi. Accordingly, for example, the nozzles in the nozzle row b are positioned between the nozzles in the nozzle row a in the nozzle-row direction.

Likewise, the nozzles in the nozzle row d are staggered with respect to the nozzles in the nozzle row c in the nozzle-row direction by the distance of 360 dpi and are positioned therebetween, the nozzles in the nozzle row f are staggered with respect to the nozzles in the nozzle row e in the nozzle-row direction by the distance of 360 dpi and are positioned therebetween, and the nozzles in the nozzle row h are staggered with respect to the nozzles in the nozzle row g in the nozzle-row direction by the distance of 360 dpi and are positioned therebetween.

As described above, the second head 42 has the same nozzle arrangement as the first head 41. However, the second head 42 is fixed to the printer 1 such that the second head 42 is staggered with respect to the first head 41 in the nozzle-row direction (a direction perpendicular to the transportation direction) by a distance of 720 dpi.

In this manner, the nozzles in the black-ink nozzle group of the second head 42 are positioned between the nozzles in the black-ink nozzle group of the first head 41 in the nozzle-row direction. Thus, ink droplets can be made to land on the sheet S with a resolution of 720 dpi in the nozzle-row direction (the sheet-width direction).

Likewise, the nozzles in the cyan-ink nozzle group of the second head 42 are positioned between the nozzles in the cyan-ink nozzle group of the first head 41, the nozzles in the magenta-ink nozzle group of the second head 42 are positioned between the nozzles in the magenta-ink nozzle group of the first head 41, and the nozzles in the yellow-ink nozzle group of the second head 42 are positioned between the nozzles in the yellow-ink nozzle group of the first head 41. Accordingly, for each of the ink colors, ink droplets can be made to land on the sheet S with the resolution of 720 dpi in the nozzle-row direction.

The first head 41 and the second head 42 are fixed to the printer 1 at an interval D0 (25.4 mm) therebetween. In each of the heads 41 and 42, nozzles in different nozzle groups are spaced apart from each other at an interval D1 in the transportation direction. The reason why nozzles in different nozzle groups are spaced apart from each other at the interval D1 in the transportation direction is that the pressure chambers 551, the reservoir 553, and so forth provided in the channel plate 55 need to be arranged, in correspondence with the nozzles, in a direction intersecting the nozzle rows. Since the foregoing elements are also provided between the nozzle row a (the nozzle row h) and the outer periphery of each head, the nozzle row a (the nozzle row h) is to be positioned at a certain distance from the outer periphery of the head.

When ink droplets are ejected from the nozzles while the sheet S is being transported in the transportation direction, the ink droplets land on the sheet S in the transportation direction. In this case, nozzles in different nozzle rows a, c, e, and g of the first head 41 are aligned in the transportation direction. Therefore, ink droplets ejected from the foregoing nozzles become aligned along common raster lines. Such a relationship also applies to the nozzles in the nozzle rows b, d, f, and h, and to the nozzles of the second head 42.

Since ink droplets of the respective colors are ejected along common raster lines, the ink droplets having the individual colors land on the sheet S in such a manner as to overlap one another.

Figure 6A:
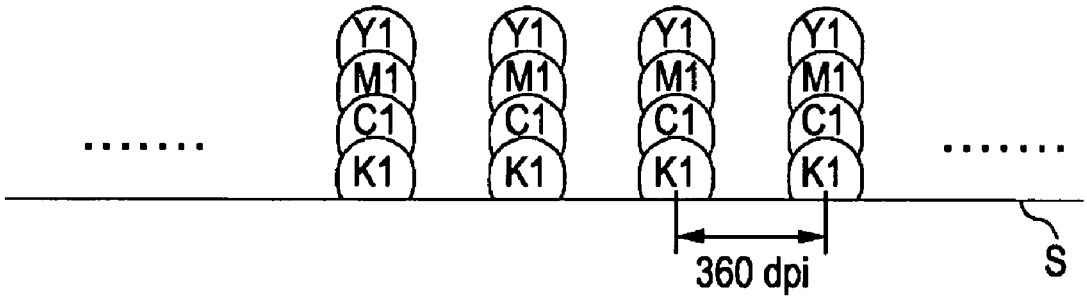
FIG. 6A shows a state where ink droplets ejected from the first head 41 have landed on the sheet S.

FIG. 6A shows a state where ink droplets ejected from the first head 41 have landed on the sheet S. Referring to FIG. 6A, in which the horizontal direction of the sheet S corresponds to the nozzle-row direction of each head, ink droplets are stacked in the order in which they land on the sheet S. In this case, as can be seen from FIG. 6A, ink droplets land on the sheet S in the order of black K, cyan C, magenta M, and yellow Y.

In FIG. 6A, the reference numerals added after the reference characters indicating the respective ink colors each denote from which of the first and second heads 41 and 42 the droplet of interest is ejected. For example, "K1" denotes the black K ink ejected from the first head 41, and "C2" denotes the cyan C ink ejected from the second head 42.

In the first head 41, the interval between the nozzles in the nozzle-row direction is 360 dpi for all the ink colors. Further, in the first head 41, the positions of the nozzles in the nozzle-row direction are the same for all the ink colors, that is, the nozzles of all the different ink colors are aligned in the transportation direction. Therefore, if ink droplets are ejected from all the nozzles of the first head 41, the ink droplets land on the sheet S with a resolution of 360 dpi.

Under such circumstances, while the sheet S is being transported in the transportation direction, ink droplets of black K, cyan C, magenta M, and yellow Y are ejected in that order onto the sheet S to form respective pixels. Accordingly, the ink droplets of black K, cyan C, magenta M, and yellow Y land on the sheet S in that order.

Figure 6B:
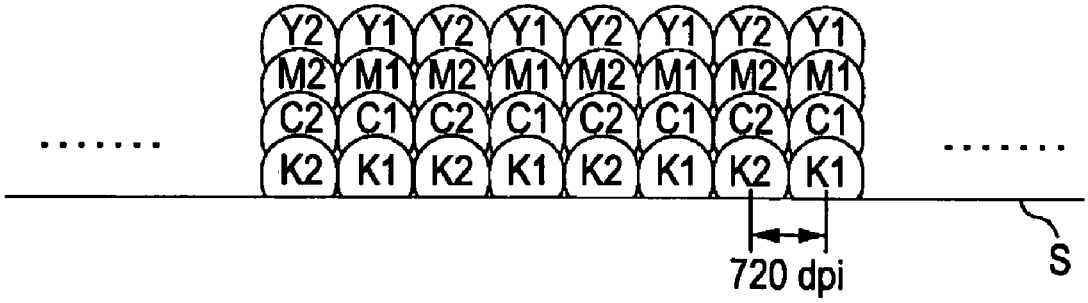
FIG. 6B shows a state where ink droplets ejected from the first head 41 and the second head 42 have landed on the sheet S.

FIG. 6B shows a state where ink droplets ejected from the first head 41 and the second head 42 have landed on the sheet S. Since the second head 42 is staggered with respect to the first head 41 in the nozzle-row direction by the distance of 720 dpi, ink droplets from the second head 42 land on the sheet S at positions staggered with respect to landing positions of ink droplets from the first head 41 by the distance of 720 dpi in the nozzle-row direction.

With such nozzle arrangements of the first and second heads 41 and 42, after the ink ejection from the black-ink nozzle group and the subsequent transportation of the sheet S by a distance corresponding to the interval D1, another ink is ejected from the cyan-ink nozzle group. Further, after the ink ejection from the cyan-ink nozzle group and the subsequent transportation of the sheet S by the distance corresponding to the interval D1, another ink is ejected from the magenta-ink nozzle group. Furthermore, after the ink ejection from the magenta-ink nozzle group and the subsequent transportation of the sheet S by the distance corresponding to the interval D1, another ink is ejected from the yellow-ink nozzle group.

The interval D1 is relatively short. Accordingly, the time elapsing in the transportation by the distance corresponding to the interval D1 is short. In such a case, for example, before the preceding black ink droplets that have landed are dried, the succeeding cyan ink droplets land on the same positions. This causes the inks that have landed on the same positions and overlapped each other to easily become mixed with each other on the sheet S.

The following embodiments of the invention each describe the printer 1 in which ink droplets are ejected in such a manner as not to easily become mixed with each other on the sheet S.

First Embodiment

Figure 7:
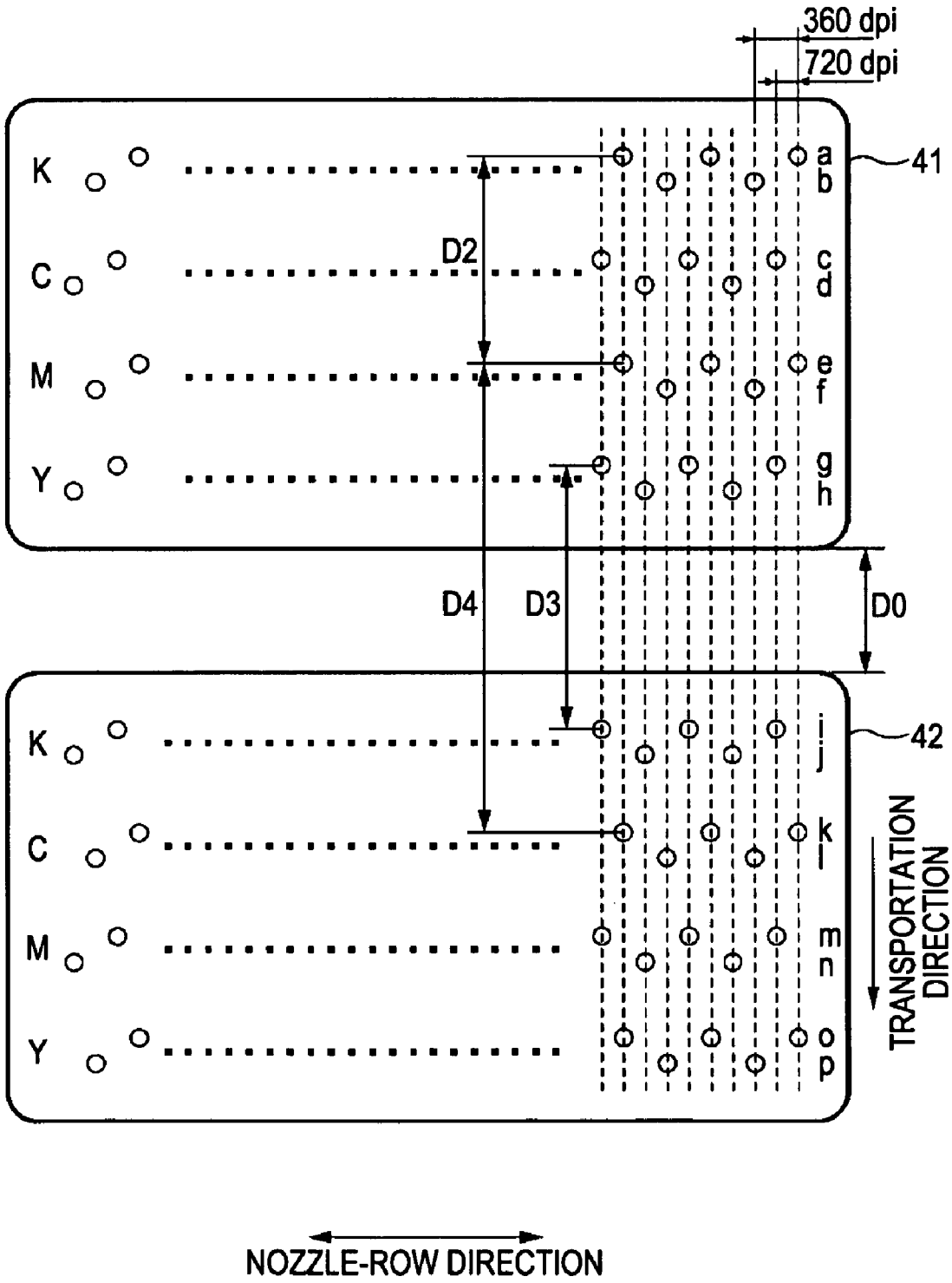
FIG. 7 shows nozzle arrangements of a first head 41 and a second head 42 according to a first embodiment.

FIG. 7 shows nozzle arrangements of a first head 41 and a second head 42 according to a first embodiment, seen from the top of the printer 1 through the other elements. Referring to FIG. 7, the first head 41 resides on the upstream side and the second head 42 resides on the downstream side in the transportation direction. The first head 41 and the second head 42 of the first embodiment have different nozzle arrangements.

The first head 41 has eight nozzle rows: nozzle rows a to h. The nozzle rows a and b constitute a black-ink nozzle group from which ink droplets of black K are ejected. The nozzle rows c and d constitute a cyan-ink nozzle group from which ink droplets of cyan C are ejected. The nozzle rows e and f constitute a magenta-ink nozzle group from which ink droplets of magenta M are ejected. The nozzle rows g and h constitute a yellow-ink nozzle group from which ink droplets of yellow Y are ejected. In short, the nozzle groups each include two nozzle rows.

The nozzles included in each of the nozzle rows a to h are arranged at a 180-dpi pitch. The two nozzle rows included in a single nozzle group are staggered with respect to each other in the nozzle-row direction by a distance of 360 dpi. For example, the nozzles in the nozzle row b are positioned between the nozzles in the nozzle row a in the nozzle-row direction.

In the first head 41, the nozzles in the black-ink nozzle group and the nozzles in the magenta-ink nozzle group are arranged at the same positions as each other in the nozzle-row direction, whereas the nozzles in the cyan-ink nozzle group and the nozzles in the yellow-ink nozzle group are staggered with respect to the nozzles in the black-ink nozzle group in the nozzle-row direction by a distance of 720 dpi.

The second head 42 of the first embodiment will now be described. The second head 42 has eight nozzle rows: nozzle rows i to p. The nozzle rows i and j constitute a black-ink nozzle group from which ink droplets of black K are ejected. The nozzle rows k and 1 constitute a cyan-ink nozzle group from which ink droplets of cyan C are ejected. The nozzle rows m and n constitute a magenta-ink nozzle group from which ink droplets of magenta M are ejected. The nozzle rows o and p constitute a yellow-ink nozzle group from which ink droplets of yellow Y are ejected. In short, the nozzle groups each include two nozzle rows.

The nozzles included in each of the nozzle rows i to p are arranged at a 180-dpi pitch. The two nozzle rows included in a single nozzle group are staggered with respect to each other in the nozzle-row direction by a distance of 360 dpi. For example, the nozzles in the nozzle row j are positioned between the nozzles in the nozzle row i in the nozzle-row direction.

Also in the second head 42, the nozzles in the black-ink nozzle group and the nozzles in the magenta-ink nozzle group are arranged at the same positions as each other in the nozzle-row direction, whereas the nozzles in the cyan-ink nozzle group and the nozzles in the yellow-ink nozzle group are staggered with respect to the nozzles in the black-ink nozzle group in the nozzle-row direction by a distance of 720 dpi.

The positions at which the first head 41 and the second head 42 are fixed to the printer 1 will now be described. The second head 42 is fixed to the printer 1 such that the nozzles in the cyan-ink nozzle group and the yellow-ink nozzle group thereof are arranged at the same positions as the nozzles in the black-ink nozzle group and the magenta-ink nozzle group of the first head 41 in the nozzle-row direction. That is, the second head 42 is fixed to the printer 1 such that the nozzles in the black-ink nozzle group and the magenta-ink nozzle group thereof are arranged at the same positions as the nozzles in the cyan-ink nozzle group and the yellow-ink nozzle group of the first head 41 in the nozzle-row direction.

Also in this case, the first head 41 and the second head 42 are fixed to the printer 1 at the interval D0 (25.4 mm) therebetween. As described above, the pressure chambers 551, the reservoir 553, and so forth provided in the channel plate 55 need to be arranged, in correspondence with the nozzles, in the direction intersecting the nozzle rows. Since the foregoing elements are also provided between the nozzle row a (the nozzle rows h, i, and p) and the outer periphery of the head, the nozzle row a (the nozzle rows h, i, and p) is to be positioned at a certain distance from the outer periphery of the head.

In such a configuration, there is an interval D2 in the transportation direction between, for example, the nozzles in the black-ink nozzle group and the nozzles in the magenta-ink nozzle group. The interval D2 is larger than the interval D1 between nozzles in adjacent nozzle groups in the reference example. Another interval D3 in the transportation direction between the nozzles in the yellow-ink nozzle group of the first head 41 and the nozzles in the black-ink nozzle group of the second head 42 is also larger than the interval D1. Another interval D4 between the nozzles in the magenta-ink nozzle group of the first head 41 and the nozzles in the cyan-ink nozzle group of the second head 42 is also larger than the interval D1.

Figure 8A:
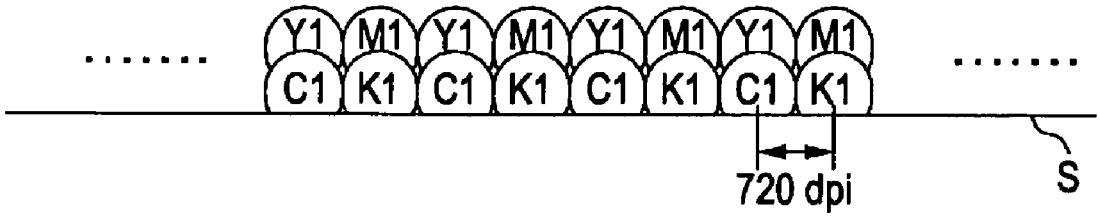
FIG. 8A shows a state where ink droplets ejected from the first head 41 of the first embodiment have landed on the sheet S.

FIG. 8A shows a state where ink droplets ejected from the first head 41 of the first embodiment have landed on the sheet S. The reference numerals added after the reference characters indicating the respective ink colors each denote from which of the first and second heads 41 and 42 the droplet of interest is ejected.

According to the nozzle arrangements in the first embodiment, the nozzles in the black-ink nozzle group and the nozzles in the magenta-ink nozzle group of the first head 41 are arranged at the same positions as each other in the nozzle-row direction. Therefore, after the ink ejection from the black-ink nozzle group and the subsequent transportation of the sheet S by a distance corresponding to the interval D2, another ink is ejected from the magenta-ink nozzle group. The interval D2 is larger than the interval D1. Accordingly, the time elapsing in the transportation by the interval D2 becomes longer. In this case, after the preceding black ink droplets that have landed have dried more, the succeeding magenta ink droplets land on the same positions. This prevents the inks that have landed on the same positions and overlapped each other from easily becoming mixed with each other on the sheet S.

The same applies to the relationship between the nozzles in the cyan-ink nozzle group and the nozzles in the yellow-ink nozzle group of the first head 41. In this case, after the preceding cyan ink droplets that have landed have dried more, the succeeding yellow ink droplets land on the same positions. This prevents the inks that have landed on the same positions and overlapped each other from easily becoming mixed with each other on the sheet S.

Figure 8B:
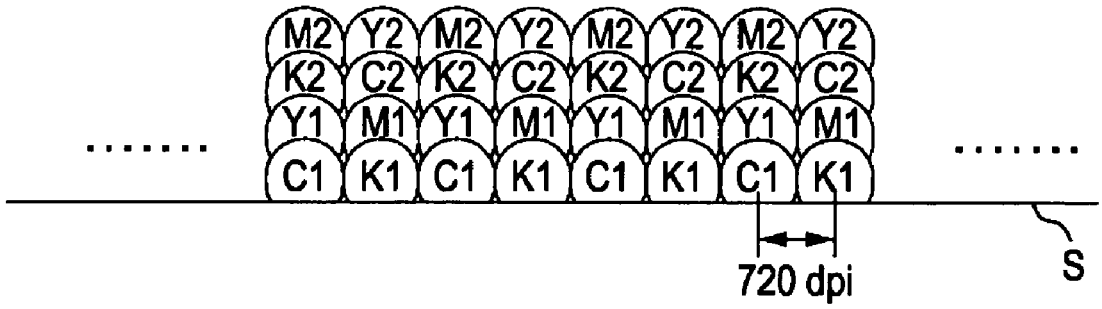
FIG. 8B shows a state where ink droplets ejected from the first head 41 and the second head 42 of the first embodiment have landed on the sheet S.

FIG. 8B shows a state where ink droplets ejected from the first and second heads 41 and 42 of the first embodiment have landed on the sheet S.

According to the nozzle arrangements in the first embodiment, the nozzles in the cyan-ink nozzle group and the yellow-ink nozzle group of the second head 42 are arranged at the same positions as the nozzles in the black-ink nozzle group and the magenta-ink nozzle group of the first head 41 in the nozzle-row direction. Therefore, after the ink ejection from the magenta-ink nozzle group of the first head 41 and the subsequent transportation of the sheet S by a distance corresponding to the interval D4, another ink is ejected from the cyan-ink nozzle group of the second head 42. The interval D4 is larger than the interval D1. Accordingly, the time elapsing in the transportation by the interval D4 becomes longer. In this case, after the preceding magenta ink droplets that have landed have dried more, the succeeding cyan ink droplets land on the same positions. This prevents the inks that have landed on the same positions and overlapped each other from easily becoming mixed with each other on the sheet S.

Further, after the ink ejection from the yellow-ink nozzle group of the first head 41 and the subsequent transportation of the sheet S by a distance corresponding to the interval D3, another ink is ejected from the black-ink nozzle group of the second head 42. The interval D3 is larger than the interval D1. Accordingly, the time elapsing in the transportation by the interval D3 becomes longer. In this case, after the preceding yellow ink droplets that have landed have dried more, the succeeding black ink droplets land on the same positions. This prevents the inks that have landed on the same positions and overlapped each other from easily becoming mixed with each other on the sheet S.

The same applies to a case of the black-ink nozzle group of the first head 41 and the cyan-ink nozzle group of the second head 42 that include nozzles arranged on common raster lines. The time from when ink droplets are ejected from the black-ink nozzle group of the first head 41 until when ink droplets are ejected from the cyan-ink nozzle group of the second head 42 is also longer than the time elapsing in the transportation by the interval D1 in the reference example. Moreover, the time from when ink droplets are ejected from the cyan-ink nozzle group of the first head 41 until when ink droplets are ejected from the black-ink nozzle group of the second head 42 is also longer than the time elapsing in the transportation by the interval D1 in the reference example. In such a case, after the preceding ink droplets that have landed have dried more, the succeeding ink droplets land on the same positions. This prevents the inks that have landed on the same positions and overlapped each other from easily becoming mixed with each other on the sheet S.

With such nozzle arrangements, ink droplets can be made to land on the sheet S with a resolution of 720 dpi, as shown in FIGS. 8A and 8B.

Although the first embodiment concerns the case where each nozzle group includes two nozzle rows, each nozzle group may alternatively include only one nozzle row. Further, although the first embodiment concerns the case where the ink colors of black K, cyan C, magenta M, and yellow Y are allocated to the respective nozzle groups in that order from the upstream side in the transportation direction, the order of the ink colors is not limited thereto.

Furthermore, although the first embodiment concerns a printer using inks of four colors, it is only necessary that at least two kinds of liquid be used. A first liquid and a second liquid, for example, each only need to include at least one kind. That is, the first liquid and the second liquid may each include two or more kinds.

Moreover, even in a case where the probability of mixing between the first liquid and the second liquid is particularly high among all the liquids used in the printer, the mixing between the first liquid and the second liquid can be suppressed by applying the first embodiment to this case. Also in a case where the first liquid and the second liquid have any other relationship, mixing between the two can be suppressed effectively.

In the first embodiment, the black-ink nozzle group of the first head 41 corresponds to a first nozzle group, the cyan-ink nozzle group of the first head 41 corresponds to a second nozzle group, the black-ink nozzle group of the second head 42 corresponds to a third nozzle group, and the cyan-ink nozzle group of the second head 42 corresponds to a fourth nozzle group.

Second Embodiment

In the first embodiment, the first head 41 and the second head 42 have different nozzle arrangements. In such a case where the first head 41 and the second head 42 have different nozzle arrangements, the number of components included in the printer 1 to be manufactured increases. This increases, for example, the manufacturing cost and consequently deteriorates the manufacturing efficiency. However, if the first head 41 and the second head 42 can be used in common, the manufacturing efficiency can be improved.

Figure 9:
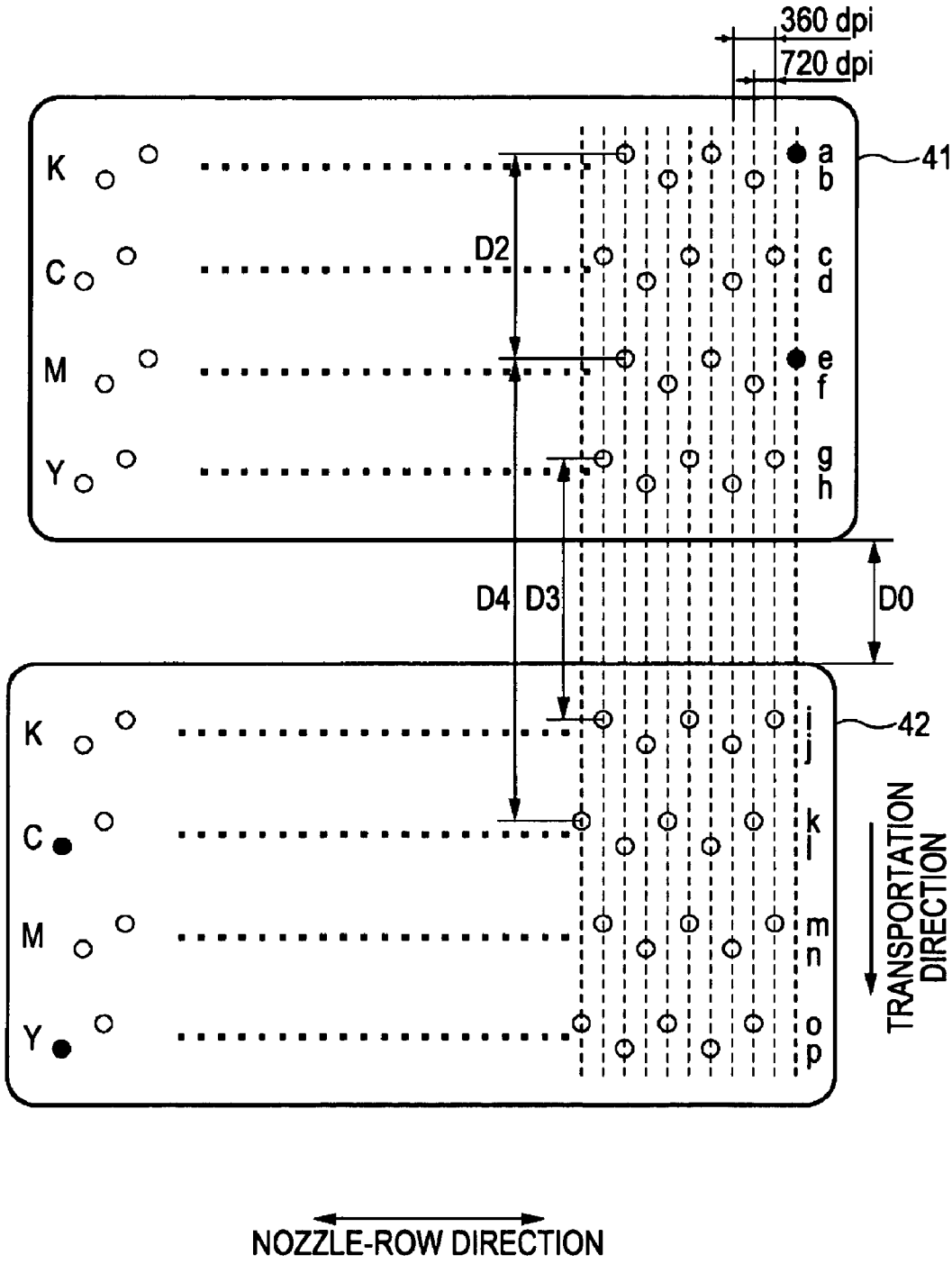
FIG. 9 shows nozzle arrangements of a first head 41 and a second head 42 according to a second embodiment.

FIG. 9 shows nozzle arrangements of a first head 41 and a second head 42 according to a second embodiment. Referring to FIG. 9, the first head 41 resides on the upstream side and the second head 42 resides on the downstream side in the transportation direction. For the reason described above, the nozzle arrangements of the first head 41 and the second head 42 of the second embodiment are the same.

The first head 41 has eight nozzle rows: nozzle rows a to h. The nozzle rows a and b constitute a black-ink nozzle group from which ink droplets of black K are ejected. The nozzle rows c and d constitute a cyan-ink nozzle group from which ink droplets of cyan C are ejected. The nozzle rows e and f constitute a magenta-ink nozzle group from which ink droplets of magenta M are ejected. The nozzle rows g and h constitute a yellow-ink nozzle group from which ink droplets of yellow Y are ejected. In short, the nozzle groups each include two nozzle rows.

The nozzles included in each of the nozzle rows a to h are arranged at a 180-dpi pitch. The two nozzle rows included in a single nozzle group are staggered with respect to each other in the nozzle-row direction by a distance of 360 dpi. For example, the nozzles in the nozzle row b are positioned between the nozzles in the nozzle row a in the nozzle-row direction.

In the first head 41, the nozzles in the black-ink nozzle group and the nozzles in the magenta-ink nozzle group are arranged at the same positions as each other in the nozzle-row direction, whereas the nozzles in the cyan-ink nozzle group and the nozzles in the yellow-ink nozzle group are staggered with respect to the nozzles in the black-ink nozzle group in the nozzle-row direction by a distance of 720 dpi.

As described above, the second head 42 has the same configuration as the first head 41. The second head 42 is fixed to the printer 1 such that the nozzles in the cyan-ink nozzle group and the yellow-ink nozzle group thereof are arranged at the same positions as the nozzles in the black-ink nozzle group and the magenta-ink nozzle group of the first head 41 in the nozzle-row direction. That is, the second head 42 is fixed to the printer 1 such that the nozzles in the black-ink nozzle group and the magenta-ink nozzle group thereof are arranged at the same positions as the nozzles in the cyan-ink nozzle group and the yellow-ink nozzle group of the first head 41 in the nozzle-row direction.

In the case where the first head 41 and the second head 42 are fixed to the printer 1 as described above, ejection of ink droplets from the nozzles shown in a filled-in manner in FIG. 9 is prevented. This is because the second head 42 has no nozzles arranged at the same positions as the filled-in nozzles provided in the first head 41 in the nozzle-row direction, and vice versa. Therefore, although ink droplets of black K and magenta M will land on the raster line corresponding to the filled-in nozzles in the first head 41, no ink droplets of cyan C and yellow Y will land thereon. It is desirable that ink droplets of all the colors can land on each raster line. For this reason, it is predetermined that the filled-in nozzles be not used.

Likewise, although ink droplets of cyan C and yellow Y will land on the raster line corresponding to the filled-in nozzles in the second head 42, no ink droplets of black K and magenta M will land thereon. As mentioned above, it is desirable that ink droplets of all the colors can land on each raster line. For this reason, it is predetermined that the filled-in nozzles be not used.

Thus, by preventing the use of some nozzles at the ends, the nozzle arrangements of the first head 41 and the second head 42 can be made uniform. Moreover, since the first head 41 and the second head 42 can be manufactured in a common process, the manufacturing efficiency can be improved. Also in the first and second heads 41 and 42 of the second embodiment manufactured in such a manner, the relationships of the intervals between nozzles described in the first embodiment can be maintained. Therefore, mixing between inks on the sheet S can be suppressed.

In the second embodiment, the black-ink nozzle group of the first head 41 corresponds to a first nozzle group, the cyan-ink nozzle group of the first head 41 corresponds to a second nozzle group, the black-ink nozzle group of the second head 42 corresponds to a third nozzle group, and the cyan-ink nozzle group of the second head 42 corresponds to a fourth nozzle group.

Third Embodiment

A third embodiment concerns a case where only one of the inks of four colors to be ejected for printing easily become mixed with the other inks. The third embodiment will now be described on the premise that particularly the yellow ink easily becomes mixed with the other inks.

Figure 10:
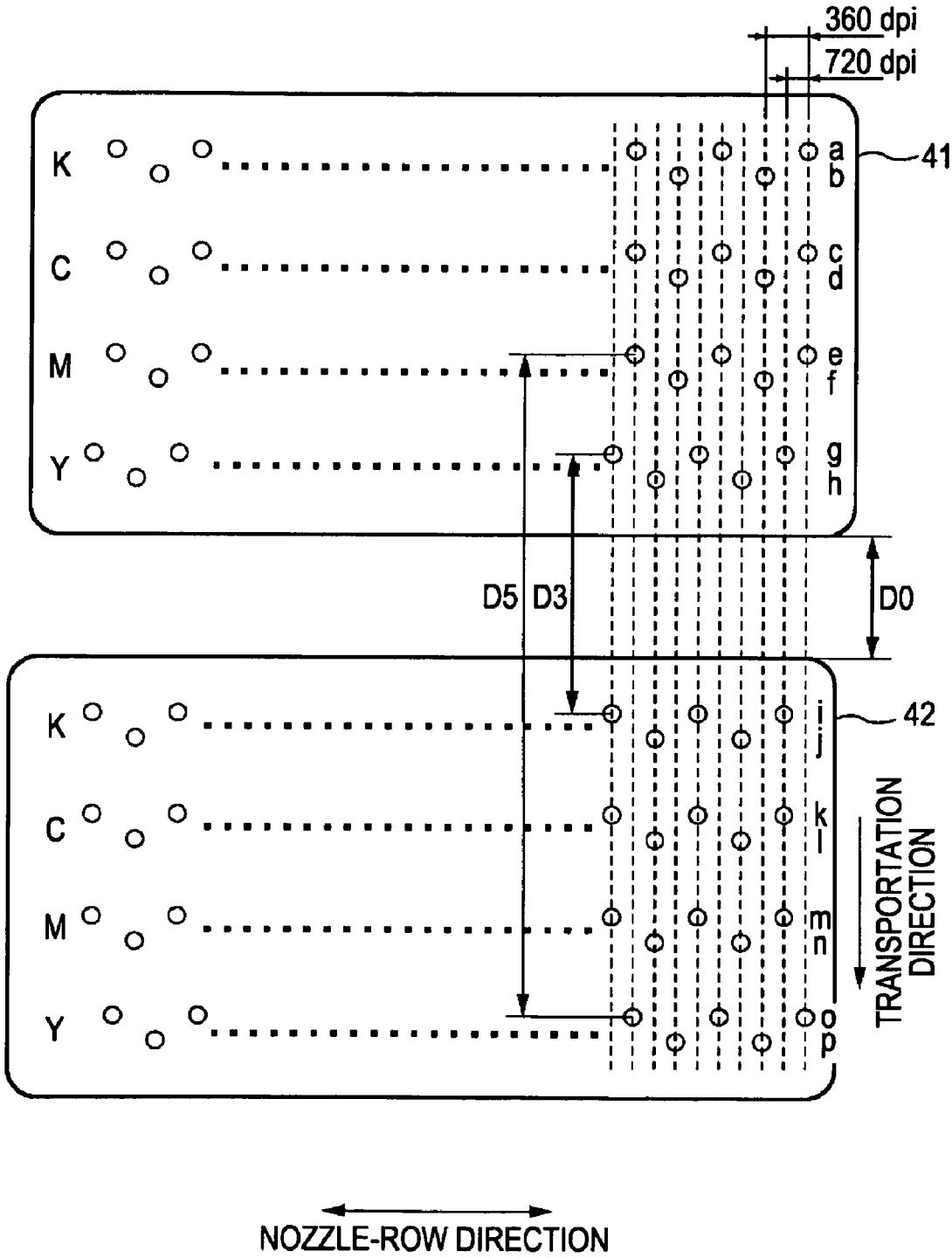
FIG. 10 shows nozzle arrangements of a first head 41 and a second head 42 according to a third embodiment.

FIG. 10 shows nozzle arrangements of a first head 41 and a second head 42 according to the third embodiment. Referring to FIG. 10, the first head 41 resides on the upstream side and the second head 42 resides on the downstream side in the transportation direction. The first head 41 and the second head 42 of the third embodiment have different nozzle arrangements.

The first head 41 has eight nozzle rows: nozzle rows a to h. The nozzle rows a and b constitute a black-ink nozzle group from which ink droplets of black K are ejected. The nozzle rows c and d constitute a cyan-ink nozzle group from which ink droplets of cyan C are ejected. The nozzle rows e and f constitute a magenta-ink nozzle group from which ink droplets of magenta M are ejected. The nozzle rows g and h constitute a yellow-ink nozzle group from which ink droplets of yellow Y are ejected. In short, the nozzle groups each include two nozzle rows.

The nozzles included in each of the nozzle rows a to h are arranged at a 180-dpi pitch. The two nozzle rows included in a single nozzle group are staggered with respect to each other in the nozzle-row direction by a distance of 360 dpi. For example, the nozzles in the nozzle row b are positioned between the nozzles in the nozzle row a in the nozzle-row direction.

In the first head 41, the nozzles in the black-ink nozzle group, the nozzles in the cyan-ink nozzle group, and the nozzles in the magenta-ink nozzle group are arranged at the same positions as each other in the nozzle-row direction, whereas the nozzles in the yellow-ink nozzle group are staggered with respect to the nozzles in the black-ink nozzle group in the nozzle-row direction by a distance of 720 dpi.

The second head 42 has the same nozzle arrangement as the first head 41, except that the nozzles in the yellow-ink nozzle group are staggered with respect to the nozzles in the black-ink nozzle group in the opposite way in the nozzle-row direction by a distance of 720 dpi. In addition, the second head 42 is fixed to the printer 1 at a position staggered with respect to the first head 41 in a direction (the nozzle-row direction) intersecting the transportation direction by a distance of 720 dpi.

Thus, the nozzles in the yellow-ink nozzle group of the first head 41 can be arranged at the same positions as the nozzles in the black-ink nozzle group, the cyan-ink nozzle group, and the magenta-ink nozzle group of the second head 42 in the nozzle-row direction. Further, the nozzles in the yellow-ink nozzle group of the second head 42 can be arranged at the same positions as the nozzles in the black-ink nozzle group, the cyan-ink nozzle group, and the magenta-ink nozzle group of the first head 41 in the nozzle-row direction.

In the third embodiment, the interval D3 between the nozzles in the yellow-ink nozzle group of the first head 41 and the nozzles in the black-ink nozzle group of the second head 42 is larger than the interval D1 between the nozzles in the adjacent nozzle groups of the first head 41 excluding the yellow-ink nozzle group. Accordingly, the time elapsing in the transportation by the interval D3 is longer than the time elapsing in the transportation by the interval D1. In this case, after the preceding yellow ink droplets that have landed have dried more, the succeeding black ink droplets land on the same positions. This prevents the yellow ink that have landed on the foregoing positions from easily becoming mixed with the other inks on the sheet S.

Likewise, an interval D5 between the nozzles in the magenta-ink nozzle group of the first head 41 and the nozzles in the yellow-ink nozzle group of the second head 42 is larger than the interval D1. Accordingly, the time elapsing in the transportation by the interval D5 is larger than the time elapsing in the transportation by the interval D1. In this case, after the preceding black, cyan, and magenta ink droplets that have been ejected from the first head 41 and landed have dried more, the succeeding yellow ink droplets that have been ejected from the second head 42 land on the same positions. This prevents the yellow ink that have landed on the foregoing positions and overlapped the other inks from easily becoming mixed with the other inks on the sheet S.

In the third embodiment, the black-ink nozzle group of the first head 41 corresponds to a first nozzle group, the yellow-ink nozzle group of the first head 41 corresponds to a second nozzle group, the black-ink nozzle group of the second head 42 corresponds to a third nozzle group, and the yellow-ink nozzle group of the second head 42 corresponds to a fourth nozzle group.

Fourth Embodiment

Figure 11:
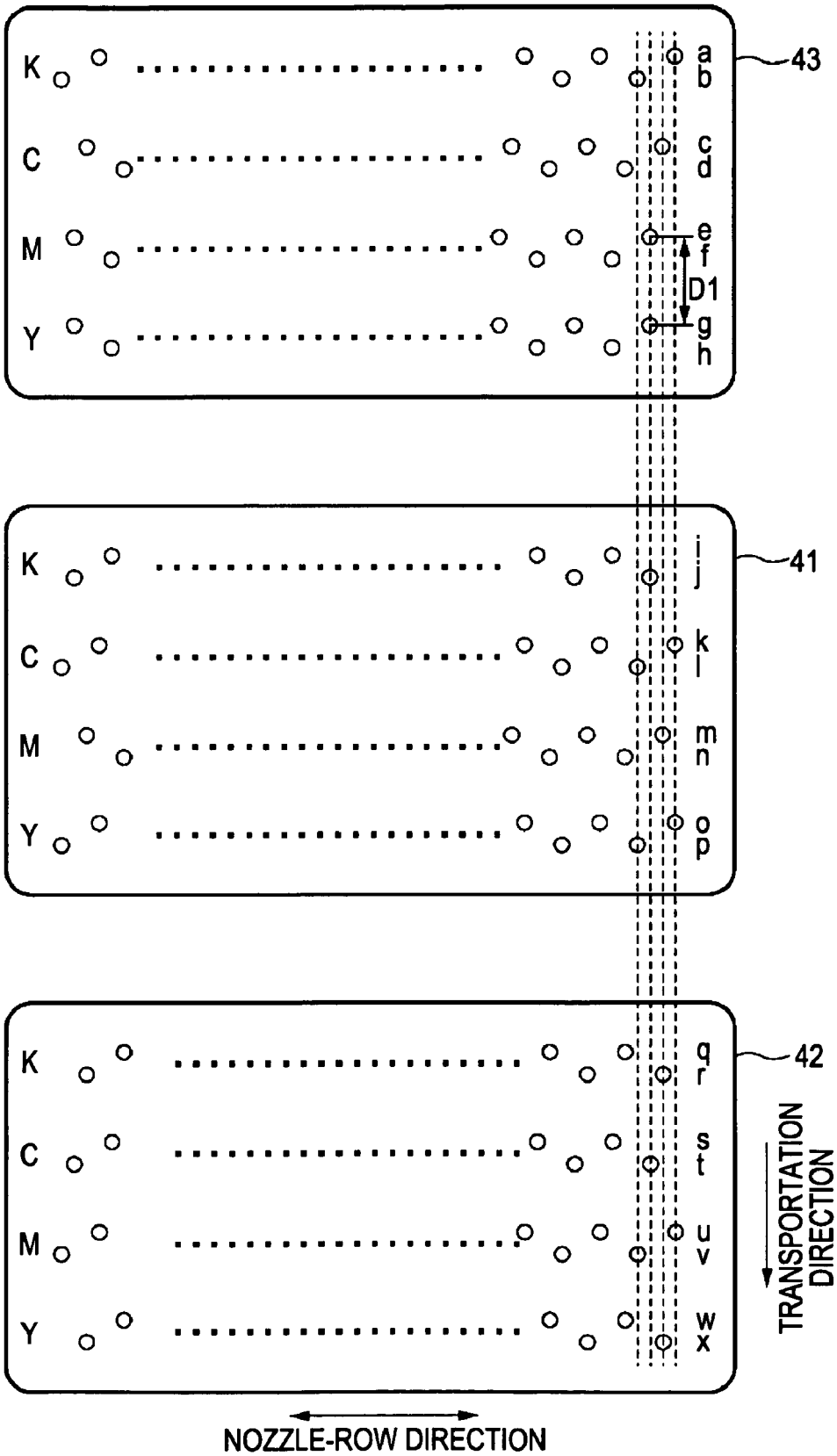
FIG. 11 shows nozzle arrangements of heads according to a fourth embodiment.

FIG. 11 shows nozzle arrangements of heads according to a fourth embodiment. The fourth embodiment concerns a case where more heads are included than in the first to third embodiments. Referring to FIG. 11, a third head 43 is provided on the most upstream side in the transportation direction, with a first head 41 and a second head 42 provided in that order on the downstream side thereof. The first to third heads 41 to 43 in the fourth embodiment have different nozzle arrangements.

In the first to third heads 41 to 43 having respective nozzle arrangements as shown in FIG. 11, only the nozzles in the magenta-ink nozzle group and the nozzles in the yellow-ink nozzle group of the third head 43 are arranged at the interval D1 therebetween. The intervals between the nozzles in the other nozzle groups in the direction intersecting the nozzle-row direction are larger than the interval D1. Therefore, the magenta ink and the yellow ink to be ejected from the third head 43 and land on the sheet S may become mixed with each other, as in the reference example. However, the intervals between the nozzles in the nozzle groups of the other inks are of such distances that those inks dry sufficiently. Therefore, printing in which mixing between inks is suppressed can be performed as a whole.

In the fourth embodiment, the black-ink nozzle group of the first head 41 corresponds to a first nozzle group, the cyan-ink nozzle group of the first head 41 corresponds to a second nozzle group, the black-ink nozzle group of the second head 42 corresponds to a third nozzle group, the cyan-ink nozzle group of the second head 42 corresponds to a fourth nozzle group, the black-ink nozzle group of the third head 43 corresponds to a fifth nozzle group, and the cyan-ink nozzle group of the third head 43 corresponds to a sixth nozzle group.

Other Embodiments

The embodiments described above concern the printer 1 corresponding to a liquid ejecting apparatus. However, the liquid ejecting apparatus is not limited to the printer and may alternatively be any other liquid ejecting apparatus that sprays or ejects any fluid other than ink, such as liquid, a solution in which particles of a functional material are dispersed, or a gel-type material. Specifically, a technique similar to those described in the above embodiments may also be applied to various apparatuses to which an ink jet technique is applied. Examples of such apparatuses include a color-filter-manufacturing apparatus, a dyeing apparatus, a microprocessing apparatus, a semiconductor-manufacturing apparatus, a surface-processing apparatus, a three-dimensional molding apparatus, a vaporizer, an organic-electroluminescent (EL)-device-manufacturing apparatus (particularly, a polymer-EL-device-manufacturing apparatus), a display-manufacturing apparatus, a depositing apparatus, and a deoxyribonucleic-acid (DNA)-chip-manufacturing apparatus. Methods, including manufacturing methods, performed in such apparatuses are also within the scope of application of the invention.

The above embodiments are intended for easier understanding of the invention and does not limit the interpretation of the invention. Needless to say, the invention may be modified and improved without departing from the intent thereof and includes any equivalents thereof.

Arrangement of Heads as Line Heads

Figure 12:
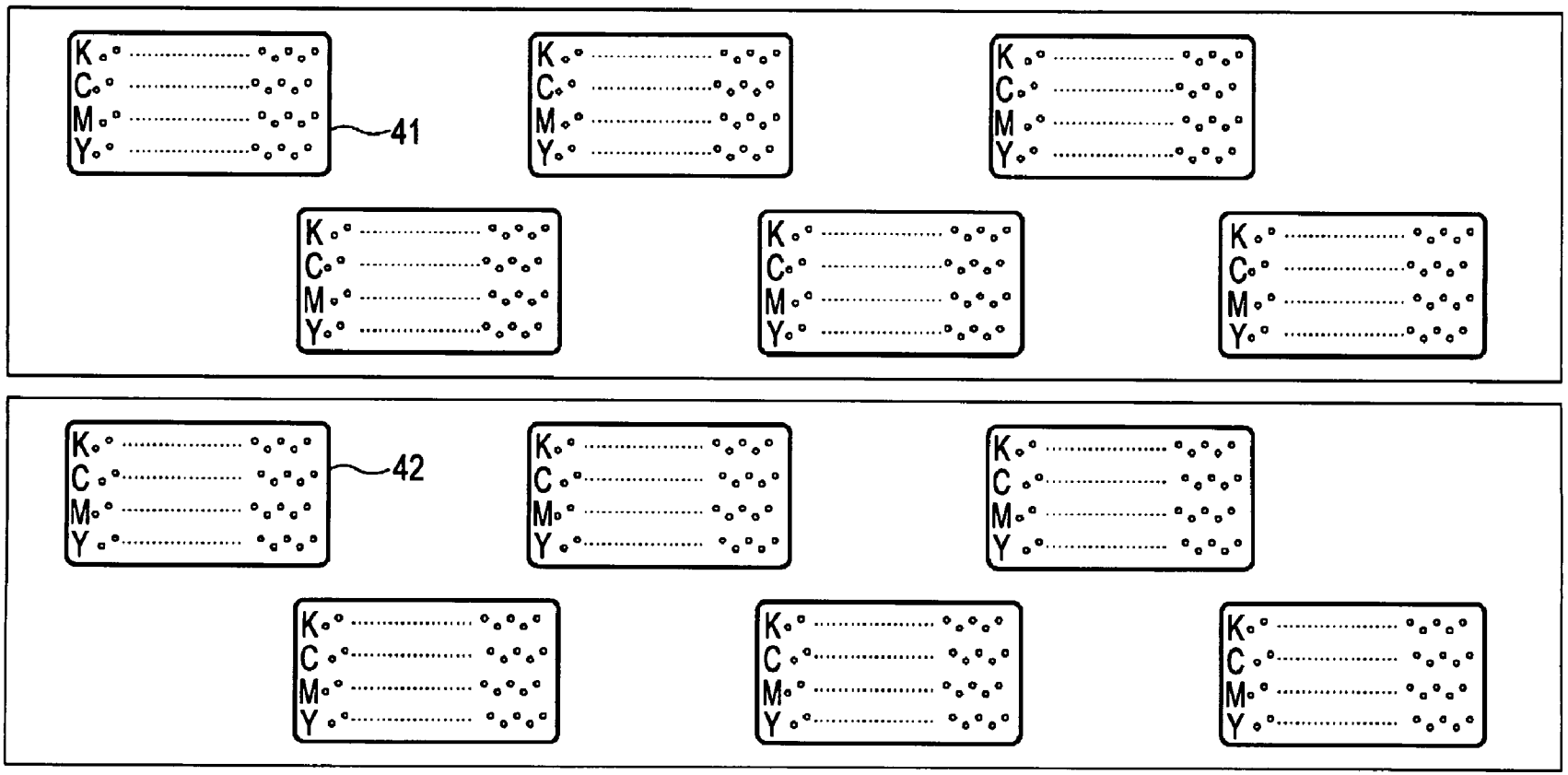
FIG. 12 shows an arrangement of heads according to another embodiment.

FIG. 12 shows an arrangement of heads according to another embodiment. In the above embodiments, each head covers one end of the sheet to the other. Alternatively, as shown in FIG. 12, a plurality of short heads may be arranged in the sheet-width direction such that ends of the adjacent heads in the nozzle-row direction overlap one another, whereby a head unit covering the full length of the sheet may be provided. In such a case, the interval between the first head 41 and the second head 42 is much larger. Therefore, according to this embodiment, mixing between ink droplets can be suppressed more.

Provision of Liquid Dryer

Referring to FIGS. 1A and 1B, a dryer 90, such as a heater, that dries the liquid ejected onto the medium may be provided inside the belt 24 that transports the medium. While the medium is being transported between the first head 41 and the second head 42 for printing, the dryer 90 promotes the drying of the liquid adhered on the medium. Thus, mixing between the first liquid and the second liquid ejected from each of the first head 41 and the second head 42 such that they overlap each other can be suppressed. Further, with the dryer 90, the interval between the first head 41 and the second head 42 can be reduced. The dryer 90 may alternatively be any other device than a heater, specifically, a hot-air blower, or a device that radiates infrared rays, ultraviolet rays, or microwave energy.

Application to Serial Printer

The above embodiments concern the case where the printer 1, to which the heads are fixed, performs printing by ejecting ink droplets while transporting a sheet in the transportation direction. However, other embodiments are also acceptable. For example, an ink jet printer having the following configuration is acceptable. The first head 41 and the second head 42 are fixed to a carriage such that the nozzle-row directions thereof becomes parallel to the transportation direction. The carriage ejects ink while moving in the sheet-width direction, and the sheet is transported intermittently, whereby printing is performed on all over the sheet.

About Head

The above embodiments concern the case where ink is ejected by utilizing piezoelectric elements. Alternatively, any other method is also acceptable for liquid ejection. For example, liquid may be ejected by generating bubbles with heat inside the nozzles.

What is claimed is:

1. A liquid ejecting apparatus comprising:

a first head having a first nozzle group in which nozzles from which a first liquid is ejected are aligned in a nozzle-row direction and a second nozzle group in which nozzles from which a second liquid is ejected are aligned in the nozzle-row direction, the nozzles in the first nozzle group being positioned between the nozzles in the second nozzle group in the nozzle-row direction;

a second head having a third nozzle group in which nozzles from which the first liquid is ejected are aligned in the nozzle-row direction and a fourth nozzle group in which nozzles from which the second liquid is ejected are aligned in the nozzle-row direction, the nozzles in the third nozzle group being positioned between the nozzles in the fourth nozzle group in the nozzle-row direction; and a moving mechanism that moves the first head and the second head relative to a medium in a transportation direction that intersects the nozzle-row direction, wherein, in the nozzle-row direction, the nozzles in the third nozzle group are positioned between the nozzles in the first nozzle group, and the nozzles in the fourth nozzle group are positioned between the nozzles in the second nozzle group; and wherein the first nozzle group, the second nozzle group, the third nozzle group, and the fourth nozzle group each include a plurality of nozzle rows in which the nozzles are aligned in the nozzle-row direction.

2. The liquid ejecting apparatus according to claim 1, wherein an interval between the second nozzle group and the third nozzle group is larger than an interval between the first nozzle group and the second nozzle group.

3. The liquid ejecting apparatus according to claim 1, wherein the first nozzle group, the second nozzle group, the third nozzle group, and the fourth nozzle group each include a single nozzle row in which the nozzles are aligned in the nozzle-row direction.

4. The liquid ejecting apparatus according to claim 1, wherein the first head and the second head are fixed to the liquid ejecting apparatus, whereas the medium is moved relative to the liquid ejecting apparatus.

5. The liquid ejecting apparatus according to claim 1, wherein the first head and the second head are moved in a direction intersecting a direction in which the medium is moved.

6. The liquid ejecting apparatus according to claim 1, wherein ejection of liquid droplets from a nozzle at either end of each nozzle group in the first head and the second head is prevented.

7. The liquid ejecting apparatus according to claim 1, wherein the nozzles in the first nozzle group and the nozzles in the fourth nozzle group are arranged at the same positions as each other in the nozzle-row direction, and the nozzles in the second nozzle group and the nozzles in the third nozzle group are arranged at the same positions as each other in the nozzle-row direction.

8. The liquid ejecting apparatus according to claim 1, further comprising:

a third head having a fifth nozzle group in which nozzles from which the first liquid is ejected are aligned in the nozzle-row direction at the predetermined pitch and a sixth nozzle group in which nozzles from which the second liquid is ejected are aligned in the nozzle-row direction at the predetermined pitch, the nozzles in the fifth nozzle group being positioned between the nozzles in the sixth nozzle group in the nozzle-row direction, wherein, in the nozzle-row direction, the nozzles in the fifth nozzle group are positioned between the nozzles in the first nozzle group, and the nozzles in the sixth nozzle group are positioned between the nozzles in the second nozzle group.

9. The liquid ejecting apparatus according to claim 1, further comprising:

a dryer with which the liquids ejected onto the medium are dried between the first head and the second head.

* * * * *